US005669157A

United States Patent [19]

Kuipers

[11] Patent Number: 5,669,157

[45] Date of Patent: Sep. 23, 1997

[54] APPARATUS AND METHOD FOR SEPARATING PIECES OF LAUNDRY

[75] Inventor: Gerardus Henricus Maria Kuipers, Berlicum, Netherlands

[73] Assignee: Amko International B.V., Kerkdriel, Netherlands

[21] Appl. No.: 649,059

[22] Filed: May 16, 1996

[30] Foreign Application Priority Data

May 18, 1995 [NL] Netherlands ..... 1000389

[51] Int. Cl.[6] ..... F26B 5/08

[52] U.S. Cl. ..... 34/321; 34/425; 34/451; 34/487; 34/499; 34/501; 34/109; 34/126; 34/599; 34/605; 34/607; 34/609; 34/620

[58] Field of Search ..... 34/318, 319, 321, 34/425, 451, 487, 499, 500, 501, 506, 545, 546, 109, 126, 599, 595, 603, 605, 607, 609, 620; 432/105

[56] References Cited

U.S. PATENT DOCUMENTS

| | | | |
|---|---|---|---|
| 3,245,154 | 4/1966 | Bojner et al. | 34/109 |
| 3,296,711 | 1/1967 | Langford et al. | 34/109 |
| 3,400,467 | 9/1968 | Drace | 34/126 |
| 3,815,257 | 6/1974 | Freze | 34/129 |
| 4,015,930 | 4/1977 | Grantham | 432/105 |
| 4,426,794 | 1/1984 | Vanderheijden | 34/109 |
| 4,933,073 | 6/1990 | Jonkers et al. | 34/109 X |
| 5,228,214 | 7/1993 | Biancalani et al. | 34/126 |

FOREIGN PATENT DOCUMENTS

| | | |
|---|---|---|
| 0152167 | 10/1984 | European Pat. Off. . |
| 0600671 | 6/1994 | European Pat. Off. . |
| 1915990 | 10/1970 | Germany . |
| 1610236 | 9/1972 | Germany . |
| 2325022 | 11/1973 | Germany . |
| 2513660 | 10/1975 | Germany . |
| 467594 | 6/1937 | United Kingdom . |

OTHER PUBLICATIONS

Webster's II New Riverside University Dictionary—"Laundry" Definition p. 680 1994.

*Primary Examiner*—John M. Sollecito
*Assistant Examiner*—Steve Gravini
*Attorney, Agent, or Firm*—Ladas & Parry

[57] ABSTRACT

A apparatus for separating pieces of laundry, comprising a drum which is rotatable about a substantially horizontal axis and with an open front and an open rear, which drum is accommodated in a housing, in which the rear of the drum is almost closed off by a stationary wall, which is provided in the middle with an engaging opening in which engaging means for engaging and feeding through the pieces of laundry are arranged, and in that in the housing air conveying means are provided for transporting the pieces of laundry from the front to the rear of the drum. A method for separating pieces of laundry with the help of the apparatus according to the invention.

30 Claims, 2 Drawing Sheets

APPARATUS AND METHOD FOR SEPARATING PIECES OF LAUNDRY

An apparatus for separating pieces of laundry has a drum which is rotatable about a substantially horizontal axis and has an open front and an open rear, the drum being accommodated in a housing. The invention also relates to an associated method.

In a laundry, laundry (washing) is washed in a rotating "washing tunnel", which consists of a number of sections. In the tunnel the laundry is successively moistened, heated, washed with soap and rinsed. The laundry is washed in the washing tunnel in parcels or lots of approximately 35 to 60 kg. After washing a laundered lot is pressed together in a press so as to press out the greater part of the rinsing water. Thus, a "cake" of compressed, moist laundry is formed.

In order to be able to mangle washed laundry each piece of laundry has to be provided with a clamp at two corner points by an insert operator with the help of an insert machine. Because the laundry is compressed into the shape of a cake, it has to first of all be tossed apart. That either takes place with the help of a "shaker", that is a drum with ribs, rotating around a horizontal axis, or with the help of one or more pre-dryers, in which the cake is tossed apart just as in a "shaker" and simultaneously dried completely or to a certain degree.

Because the laundry has been continually rotated in the washing tunnel, the laundry is, in itself, very tangled up. In a shaker or a pre-dryer a compressed cake is indeed tossed apart, but the laundry remains tangled up. The more so in view of the fact that the shaker or the pre-dryer itself rotates, whereby a piece of laundry which becomes loose still gets tangled up with the remaining laundry again.

In consequence, prior to insertion the insert operator has to pull a piece of laundry out of a tangled ball of laundry, which requires a considerable physical effort and causes considerable loss of time. With the help of a common insertion machine the operator processes on average one piece of laundry approximately every 10 seconds. Pulling the piece of laundry out of the ball takes approximately 6 of those 10 seconds.

It is an object of the invention to reduce this loss of time.

For this purpose the invention provides an apparatus for separating pieces of laundry of the type described in the introduction to the description, in which the rear of the drum is almost closed off by a stationary wall, which is provided in the middle with an engaging opening in which engaging means for engaging and feeding through the pieces of laundry are arranged, and in which in the housing air conveying means are provided for transporting the pieces of laundry from the front to the rear of the drum.

When using the apparatus the laundry is carried upwards and tossed apart, just as with a shaker. Pieces of laundry which become loose and tumble down, are conveyed by the air, which is provided by the air conveying means, from the front to the rear of the drum. At the rear wall a tumbling piece of laundry is engaged by the engaging means, which pull the piece of laundry at a high speed out of the drum through the engaging opening. Also if two or three pieces of laundry are entangled, the engaging means will loosen the engaged piece of laundry from the other pieces of laundry in this way. The pieces of laundry have then been separated from one another and carried out of the drum, so that they do not become entangled again. The insert operator can now pull a piece of laundry out of a pile without much difficulty, whereby a time gain of approximately 4 seconds per piece of laundry is achieved.

According to a advantageous embodiment the engaging means comprise at least one high friction endless conveyor belt, whereby a simple and continually available engagement is provided.

In this case, the engaging opening is, for example, an equilateral triangle with downwardly directed tip, a conveyor belt extending backward from both downwardly running edges, which conveyor belts form a tunnel together with a top plate. Because of the formation of a tunnel a strong air current through the engaging opening is formed, which draws the pieces of laundry to the engaging means. By including two V-shaped endless conveyor belts in the tunnel, always at least one conveyor belt will keep engaging an engaged piece of laundry and keep pulling it out of the drum, even if the piece of laundry, for example a sheet, is pulled aside by the rotation of the drum.

According to an advantageous embodiment the engaging opening is a rectangle, in which a conveyor belt extends to the rear from the long sides, which conveyor belts run substantially horizontally and form a tunnel together with side plates, in which preferably at the front side of the tunnel in the side walls an opening is arranged to blow air into the tunnel, so that a piece of laundry will always be engaged by the lowest and in most cases by both conveyor belts, in which the air blown in through the openings in the side walls prevents a piece of laundry from remaining suspended in a corner of the engaging opening.

It is, furthermore, advantageous if the top side of the tunnel can be pushed upward to allow tangles of laundry through, so that the engaging opening cannot be blocked up.

According to an advantageous embodiment the stationary rear wall is formed in such a way that the engaging opening is positioned at a distance before the open rear of the drum, in the drum, whereby the pieces of laundry do not have to tumble very close along the rear wall, but are engaged more to the fore in the drum. Likewise, sheets which tumble onto the part of the rear wall projecting to the fore then automatically slide in front of the engaging opening and are engaged.

Preferably the air conveying means comprise a suction box which is mounted behind the drum and which comprises at the top a first ventilator for extracting air through the engaging opening. In addition, the first ventilator preferably blows the air extracted through the engaging opening at the front into the drum again.

Tests have shown that the apparatus works well if a small number of sheets are simultaneously inserted into the drum. In order to separate large numbers of pieces of laundry inserted simultaneously into the drum, the apparatus according to an advantageous embodiment is arranged in such a way that the drum is divided into two at approximately halfway along its length with the help of a dividing wall with an opening therein, whereby a forward part and a rearward part of the drum are formed, for pre-separating pieces of laundry, that at least the forward part of the drum is perforated and that at least one second ventilator is arranged for blowing the air extracted by the first ventilator through the engaging opening at the side of the drum into the drum. On account of the dividing wall large balls of laundry remain in the forward part of the drum and only separate pieces of laundry are allowed through the opening in the dividing wall to the rear part of the drum. So that the laundry is spread out sufficiently and "flies", that is floats on the air provided by the air conveying means, in this embodiment the air has to be blown from the side into the drum, so that enough loose pieces of laundry are led quickly enough through the opening into the rear part of the drum.

According to a preferred embodiment the opening in the dividing wall is substantially shaped as a sector of a circle and takes up approximately ⅕ of the surface of the circle; it has been found in tests that this shape gives a reasonable pre-separation.

According to another preferred embodiment the dividing wall is substantially annular, preferably a tube portion projecting to the rear from the opening in the substantially annular dividing wall, a number of teeth being arranged on the inner side of the tube portion, which teeth are arranged obliquely to the tube portion, such that as seen in the direction of rotation their front edge faces towards the engaging opening. By means of an annular dividing wall a reasonable pre-separation is in itself already obtained. By arranging the teeth on the tube portion an excellent pre-separation is obtained, in view of the fact that balls of laundry which would fall over the edge of the annular dividing wall into the rear part of the drum are thrown back by the slanted teeth, whilst sufficient room remains for letting loose pieces of laundry through.

According to an advantageous embodiment the drum divided into two consists of two parts which are rotatable independent of each other, the forward part to which the dividing wall is attached, and the rearward part to which the stationary rear wall is adjacent. By doing so, the rearward part of the drum can be rotated at such a speed that the pieces of laundry tumble down just along the front of the engaging opening and can thus be engaged well by the engaging means, whilst the forward part of the drum can be rotated at a higher speed as a result of which an inserted "cake" of laundry is beaten apart into single pieces of laundry more quickly.

In order to blow the air at the side of the drum into the drum preferably a blowing tray is arranged on the side of the drum, which connects to the second ventilator via a channel, and slanting baffles are arranged in the blowing tray for blowing air transversely to the rear in the forward part of the drum. By blowing the air transversely to the rear the pieces of laundry are conveyed better from the first to the second part of the drum.

According to an advantageous embodiment at the front of the housing a third ventilator is arranged and a baffle is arranged in the housing for blowing in air transversely upwards and to the rear into the drum in a fan-shaped way, this air being drawn in from the housing, in order to blow the laundry apart additionally in the forward part of the drum.

Preferably an air jet opening is arranged in the front of the housing, which is preferably connected to the blowing tray by means of a channel with a stop valve, so as to blow air from the front into the drum, if so desired, so that the last pieces of laundry which have the tendency to remain in the front part of the drum, are conveyed to the engaging opening and can be removed from the drum by blowing air for some time through the air jet opening.

In order to remove the pieces of laundry, the invention provides a measure that at the bottom of the suction box, under the engaging opening, first belt belt conveyor means are arranged for carrying out of the suction box the laundry pulled out of the drum and that at the location where a endless conveyor belt of the belt conveyor means leaves the suction box, a flattening roller is arranged, the flattening roller and/or the conveyor belt being spring-mounted at that location. The flattening roller is arranged to ensure that the ventilator of the suction box sucks in as little air as possible from outside the apparatus, and the flattening roller and/or the conveying means are spring-mounted so that piles or tangles of laundry, too, can be carried out of the suction box.

According to an advantageous embodiment above the first conveyor belt at a level with the engaging opening second belt conveyor means and a second flattening roller are arranged for carrying small pieces of laundry out of the suction box.

The drum is, as is usual, provided on the inside with ribs extending in longitudinal direction for leading a cake of compressed laundry upwards in direction of rotation. According to an advantageous embodiment the ribs are provided with baffles, which, as seen in direction of rotation of the drum, project obliquely to the fore. By arranging these projecting baffles a cake is tossed apart more quickly and a better so-called "rain effect" is formed, which means that after being lead upwards by the drum the pieces of laundry fall down better in a manner separate from one another and can thus be conveyed more easily and quickly to the rear part of the drum.

Preferably in the suction box an opening is arranged which is can be shut off by a valve, preferably in the top side of the suction box, in order to lead fresh air without moisture into the apparatus, if so desired.

According to a preferred embodiment means are arranged for heating the air which transports the pieces of laundry from the front to the rear of the drum, so that the apparatus can also serve as pre-dryer, or to dry the laundry further after a pre-dryer.

The invention also provides a method for separating pieces of laundry with the help of an apparatus according to the invention, in which air is fed through the drum from the front to the rear and through the engaging opening in the stationary rear wall to transport the laundry, in which the drum is rotated for leading the laundry upwards, causing it to tumble down and spread out, and in which the pieces of laundry are engaged with the help of the engaging means in order to pull them substantially one by one out of the drum.

Preferably the pieces of laundry are pre-separated in the drum with the help of a dividing wall with an opening therein, whereby a forward part and a rearward part of the drum is formed, so that the laundry arrives at the engaging opening substantially one by one, and in an advantageous manner the forward part of the drum is rotated more quickly than the rearward part to let the pieces of laundry in the forward part spread out quickly, and in order to bring the pieces of laundry in the rearward part just in front of the engaging opening.

Preferably the rearward part of the drum is rotated at a peripheral speed of approximately 150 m/min. At this rotational speed no air has to be blown through the side wall of the rearward part of the drum in order to bring the pieces of laundry in front of the engaging opening.

Preferably, after throwing in a cake of laundry the forward part of the drum is rotated for some time at a peripheral speed of 150 m/min in order to toss the cake apart, and then rotated at a speed of 150 to 200 m/min, seeing as from tests it has been shown that a peripheral speed of 150 m/min is an optimal peripheral speed for tossing a cake apart, in particular if the ribs in the drum are elongated by baffles projecting obliquely to the fore in direction of rotation. After tossing apart the forward part can be rotated at a higher speed in order to obtain a quicker pre-separation. A peripheral speed higher than 200 m/min is less suited because of the higher centrifugal force.

It is advantageous that for some time air can be blown into the drum from the front side of the housing in order to remove the last pieces of laundry out of the drum.

Preferably fresh air without moisture is periodically lead into the housing, whereby a certain pre-drying of the laundry is attained. In addition, the advantageous effect occurs that by admitting fresh air the air transport through the drum is interrupted, as a result of which the balls of laundry which abut the dividing wall fall back into the forward part of the drum. In that way they are tossed apart better by the ribs in the forward part of the drum. During the period for processing one cake, fresh air is therefore admitted a few times into the housing.

In order to dry the laundry at least partially the air which is led through the drum is preferably heated.

The invention will now be elucidated on the basis of the drawing.

Figure 1:
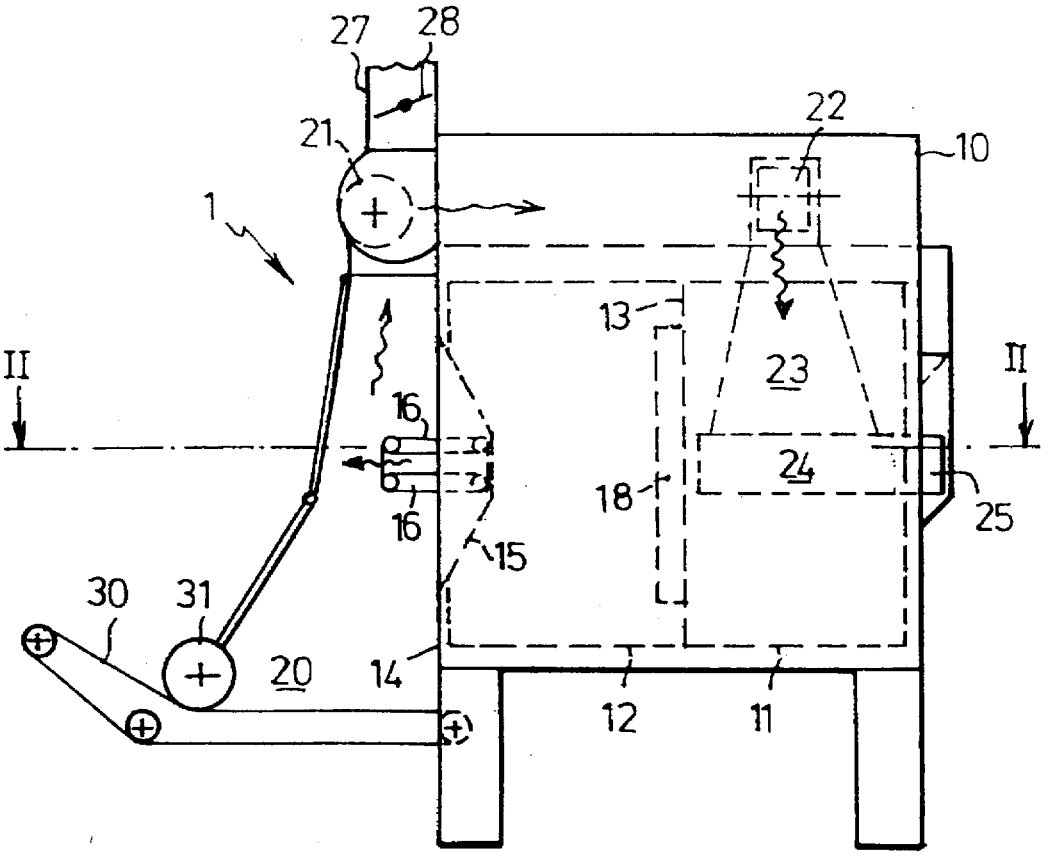
FIG. 1 shows schematically a preferred embodiment of the apparatus according to the invention in side view.

FIG. 1 shows a preferred embodiment of a separating apparatus 1, with a housing 10 in which a drum 11, 12 is rotatably arranged. The drum 11, 12 has an open front and is almost closed off at the rear by a stationary wall 14, which is part of the housing 10. The drum consists of a forward part 11 with a dividing wall 13, and a rearward part 12. The forward part 11 and the rearward part 12 are rotatable at different speeds. The dividing wall 13 which is attached to the forward part of the drum 11 is annular, a short tube portion 18 being arranged on the inner edge of the annular dividing wall 13. On the inner side of the tube portion 18 almost rectangular teeth 19 with rounded-off corners are arranged, see also FIG. 3. The teeth are somewhat slanting, their front edge being directed to the engaging opening as seen in the direction of rotation of the drum. The wall of the drum part 11 is perforated.

Figure 5:
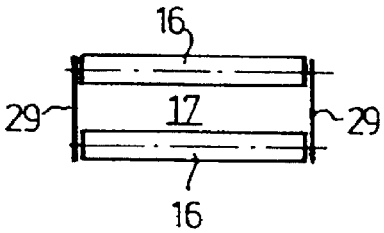
FIG. 5 shows a detail of the apparatus according to the invention.

The rear wall 14 of the housing 10 has a part 15 projecting to the fore in the rearward part 12 of the drum, in which an engaging opening 17 is arranged. This opening 17 is shown in more detail in FIG. 5 and has the shape of a rectangle, an endless conveyor belt 16 projecting to the rear from the long sides thereof. Together with side plates 29 these conveyor belts 16 form a tunnel, which projects into a suction box 20.

In FIG. 1 the forward side wall of the suction box 20 is omitted. At the top of the suction box 20 there is a ventilator 21 for extracting air out of the drum 11, 12 into the suction box 20 through the tunnel, made by two endless conveyor belts 16 and the side plates 29. A channel 27 with a butterfly valve 28 is arranged at the top in the suction box 20 for sucking fresh air into the separating apparatus.

Figure 2:
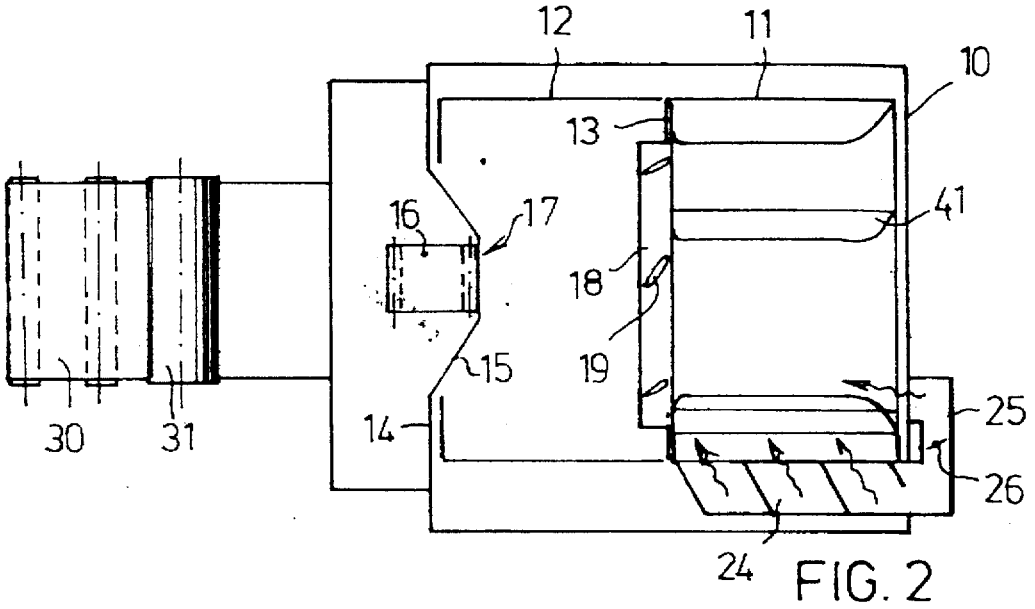
FIG. 2 shows a cross section of the apparatus according to the line II—II of FIG. 1.

At the top of the housing 10 a ventilator 22 is arranged and communicates with an air channel 23 in order to blow air into the drum with the help of a blowing tray 24, see also FIG. 2. In the blowing tray 24 slanting baffles are arranged, to blow air obliquely to the rear into the forward part 11 of the drum. The blowing tray 24 is arranged substantially at a level with the center line of the drum at the side of the drum.

Figure 3:
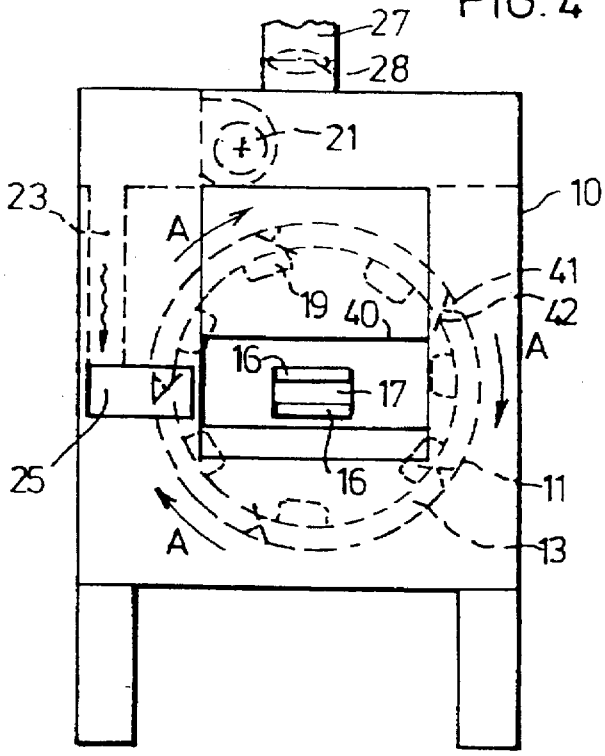
FIG. 3 shows a front view of the apparatus of FIG. 1.

In the front of the housing 10 an insert opening 40 is arranged for the laundry, see FIG. 3. Also on the front of the housing 10 an air jet opening is arranged, which communicates by means of a channel 25 with a stop valve 26 to the blowing tray 24 at the side of the drum.

FIG. 1 shows the suction box 20 at the rear of the housing 10 of the separating apparatus 2. In order to remove laundry which has been separated by the separating apparatus, an endless conveyor belt 30 is arranged on the lower side of the suction box 20 which extends outside the suction box 20. A spring-mounted flattening roller 31 is arranged on the conveyor belt 30 for allowing piles or tangles of laundry to pass.

FIG. 3 shows that the drum 11, just as with a shaker, has inwardly extending ribs 41 for carrying the laundry upwards. These ribs 41 are provided with baffles 42 projecting obliquely to the fore in the direction of rotation.

Figure 4:
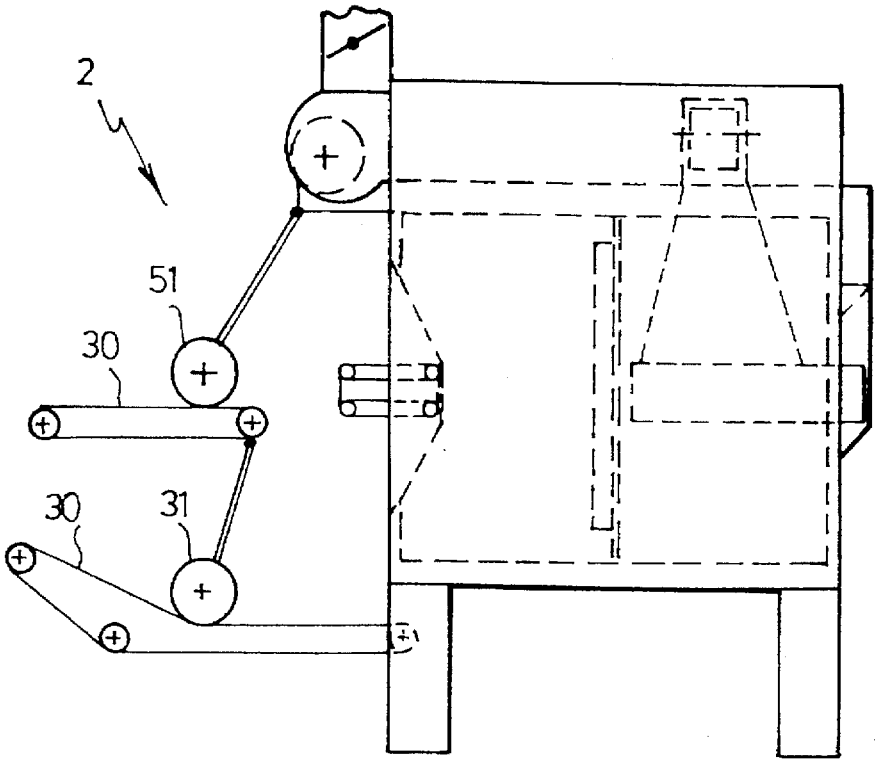
FIG. 4 shows another preferred embodiment of the apparatus according to the invention in side view.

In FIG. 4 a second preferred embodiment of a separating apparatus 2 according to the invention is shown, which corresponds to the first embodiment of the separating apparatus 1 described above, but in which in the suction box 20 above the endless conveyor belt 30 a second endless conveyor belt 50 is arranged at a level with the opening 17. A second spring-mounted flattening roller 51 rests on the conveyor belt 51.

The conveyor belts, the ventilators and the two parts of the drum are driven by driving means which are not shown in the drawing.

The method for separating pieces of laundry according to the invention can be carried out with the separating apparatus 1 or 2, as described below.

A cake of compressed laundry or a quantity of predryed laundry is tossed into the front part 11 of the drum through the opening 40 in the front part of the housing 10. The drum 11 carries the laundry with the help of the ribs 41 with baffles 42 and with the help of the centrifugal force upwards according to the arrows A, which indicate its rotational direction. The ribs 41 with the baffles 42 beat a cake of compressed laundry apart. Once the pieces of laundry have arrived in the upper part of the drum 11 the pieces of laundry will again tumble down. The air blown into the drum by the ventilator 22 via the blowing tray 24 helps to let the sheets "fly", whereby the sheets are loosened from one another. The slanting baffles in blowing tray 24 are there to move the laundry in the direction of the dividing wall 13.

The opening in the tube-shaped part 18 with the teeth 19 retains balls of laundry in the forward part 11 of the drum, but lets separate pieces of laundry through to the rearward part 12 of the drum. The rearward part 12 of the drum rotates at a rotational speed of about 150 m/min, such that the pieces of laundry tumble down just in front of the engaging opening 17 in the rear wall 14. The forward part 11 of the drum rotates at a same high speed in order to beat a cake of laundry apart as quickly as possible and at a higher speed to allow the pieces of laundry to tumble down more often. As soon as a piece of laundry tumbles down near enough in the front of the engaging opening 17, a part of the piece of laundry is pulled into the tunnel by the suction action of the air which is extracted by the ventilator 21 via the suction box 20 through the tunnel out of the drum. Consequently, the piece of laundry comes to lie on the lower conveying belt 16 which pulls the piece of laundry at a high speed out of the drum and conveys it through the tunnel into the suction box 20. The upper conveyor belt 16 can, moreover, help to transport larger pieces of laundry. In the side walls 29 of the tunnel there are openings (not shown) close by the engaging opening 17 for blowing air into the tunnel, so that a piece of laundry will not remain caught behind the side edge of the engaging opening.

In the case of the separating apparatus 1 of FIG. 1 all the laundry then tumbles on the conveyor belt 30 which conveys the separated laundry out of the suction box 20. In the case of the separating apparatus 2 according to FIG. 4 small pieces of laundry will fly to the rear on account of the speed of the conveyor belts 16 and be carried out of the suction box 20 by the conveyor belt 50, whereas, on account of their greater weight, the larger pieces of laundry tumble on the conveyor belt 30 and will be carried by the latter out of the suction box 20.

The ventilators 21 and 22 provide for an air conveying cycle through the air channel 23, the blowing tray 24, the drum 11, 12, the tunnel 16, 29 and the suction box 20, and then again through the ventilators 21 and 22, which is as well closed as possible. It will be clear that as far as possible all mutually moving parts are closed in an air-tight way.

Because the last pieces of laundry have the tendency to remain in the forward part 11 of the drum, air directed to the rear is blown out of the channel 25 into the drum if these last pieces of laundry are not to get mixed up with laundry from a following cake.

Because the air in the separating apparatus becomes saturated by the moist laundry, it is desirable to periodically suck fresh, non-saturated air into the housing 10. For this purpose air is drawn by the ventilator 21 through the channel 27. Because the air transport in the drum is disturbed by this, balls of laundry which are driven against the dividing wall 13 fall back into the forward part 11 of the drum, as a result of which they are separated better.

It can be desired that during separation the laundry undergoes a certain drying. To that end heating means for heating the air and condensation means for the evaporated water are arranged in the air conveying system. These means are not shown in the drawing.

I claim:

1. Apparatus comprising:

a means for separating pieces of laundry comprising a drum which is rotatable about a substantially horizontal axis and with an open front and an open rear, which drum is accommodated in a housing:

a stationary rear wall adjacent the rear of the drum so as to substantially close off the open rear of the drum, which stationary wall is provided in its middle with an engaging opening in which engaging means for engaging and feeding through the pieces of laundry are arranged; and air conveying means in the housing for transporting the pieces of laundry from the front to the rear of the drum.

2. Apparatus according to claim 1, characterized in that the engaging means comprise at least one high friction endless conveyor belt.

3. Apparatus according to claim 2, characterized in that the engaging opening is an equilateral triangle with downwardly directed tip, a conveyor belt extending backward from both downwardly running edges, which conveyor belts form a tunnel together with an top plate.

4. Apparatus according to claim 2, characterized in that the engaging opening is a rectangle, in which a conveyor belt extends to the rear from the long sides, which conveyor belts run substantially horizontally and form a tunnel together with side plates.

5. Apparatus according to claim 4, characterized in that at the front side of the tunnel in the side walls an opening is arranged to blow air in the tunnel.

6. Apparatus according to claim 3, characterized in that the top side of the tunnel can be pushed upward to allow a tangle of laundry through.

7. Apparatus according to claim 1, characterized in that the stationary rear wall is formed such that the engaging opening is positioned at a distance before the open rear of the drum, in the drum.

8. Apparatus according to claim 1, characterized in that the air conveying means comprise a suction box which is mounted behind the drum and which comprises at the top a first ventilator for extracting air through the engaging opening.

9. Apparatus according to claim 8, characterized in that the first ventilator blows the air extracted through the engaging opening at the front into the drum again.

10. Apparatus according to claim 8, characterized in that the drum is divided into two at approximately halfway along its length with the help of a dividing wall with an opening therein, whereby a forward part and a rearward part of the drum are formed, for pre-separating pieces of laundry, in that at least the forward part of the drum is perforated and in that at least one second ventilator is arranged for blowing the air extracted by the first ventilator through the engaging opening at the side of the drum into the drum.

11. Apparatus according to claim 10, characterized in that the opening in the dividing wall is substantially shaped as a sector of a circle and takes up approximately ⅕ of the surface of the circle.

12. Apparatus according to claim 10, characterized in that the dividing wall is substantially annular.

13. Apparatus according to claim 12, characterized in that a tube portion projects to the rear from the opening in the substantially annular dividing wall, a number of teeth being arranged on the inner side of the tube portion, which teeth are arranged obliquely to the tube portion, such that as seen in direction of rotation, their front edge faces towards the engaging opening.

14. Apparatus according to claim 10, characterized in that the drum divided into two consists of two parts which are rotatable independent of each other, the forward part to which the dividing wall is attached, and the rearward part to which the stationary rear wall is adjacent.

15. Apparatus according to claim 10, characterized in that at the side of the drum a blowing tray is arranged, which connects to the second ventilator via a channel, and in that slanting baffles are arranged in the blowing tray for blowing air transversely to the rear in the forward part of the drum.

16. Apparatus according to claim 10, characterized in that at the front of the housing a third ventilator is arranged and in that a baffle is arranged in the housing for blowing in air crosswise upwards and to the rear into the drum in a fan-shaped way, this air being drawn in from the housing.

17. Apparatus according to claim 15, characterized in that an air jet opening is arranged in the front of the housing, which is preferably connected to the blowing tray by means of a channel with a stop valve, so as to blow air from the front into the drum, if so desired.

18. Apparatus according to claim 8, characterized in that at the bottom of the suction box, under the engaging opening, first belt conveyor means are arranged for carrying out of the suction box the laundry pulled out of the drum and in that at the location where an endless conveyor belt of the belt conveyor means leaves the suction box a flattening roller is arranged, the flattening roller and/or the conveyor belt being spring-mounted at that location.

19. Apparatus according to claim 18, characterized in that above the first conveyor belt at a level with the engaging opening second belt conveyor means and a second flattening roller are arranged for carrying small pieces of laundry out of the suction box.

20. Apparatus according to claim 1, in which the drum is provided on the inside with ribs extending in longitudinal direction, characterized in that the ribs are provided with baffles, which, as seen in direction of rotation of the drum, project obliquely to the fore.

21. Apparatus according to claim 8, characterized in that in the suction box an opening is arranged which can be shut off by a valve, preferably in the top side of the suction box, in order to lead fresh air without moisture into the apparatus, if so desired.

22. Apparatus according to claim 1, characterized in that means are arranged for heating the air which transports the pieces of laundry from the front to the rear of the drum.

23. Method for separating pieces of laundry with the help of the apparatus according to claim 1, characterized in that air is fed through the drum from the front to the rear and through the engaging opening in the stationary rear wall to transport the laundry, in that the drum is rotated for leading the laundry upwards, causing it to tumble down and spread out, and in that the pieces of laundry are engaged with the help of the engaging means in order to pull them substantially one by one out of the drum.

24. Method according to claim 23, characterized in that the pieces of laundry are pre-separated in the drum with the help of a dividing wall with an opening therein, whereby a forward part and a rearward part of the drum is formed, so that the laundry arrives at the engaging opening substantially one by one.

25. Method according to claim 24, characterized in that the forward part of the drum is rotated more quickly than the rearward part in order to let the pieces of laundry in the forward part spread out quickly, and in order to bring the pieces of laundry in the rearward part just in front of the engaging opening.

26. Method according to claim 25, characterized in that the rearward part of the drum is rotated at a peripheral speed of approximately 150 m/min.

27. Method according to claim 25, characterized in that after throwing in a cake of laundry the forward part of the drum is rotated for some time at a peripheral speed of 150 m/min in order to toss the cake apart, and then rotated at a speed of 150 to 200 m/min.

28. Method according to claim 23, characterized in that for some time air is blown into the drum from the front side of the housing in order to remove the last pieces of laundry out of the drum.

29. Method according to claim 24, characterized in that periodically fresh air without moisture is led into the housing.

30. Method according to claim 23, characterized in that the air which is led through the drum is heated.

* * * * *